US007735163B2

(12) United States Patent
Comitino et al.

(10) Patent No.: US 7,735,163 B2
(45) Date of Patent: Jun. 15, 2010

(54) SWIMMING POOL GAP SECUREMENT ASSEMBLY

(75) Inventors: MaryEllen Comitino, Commack, NY (US); LeeAnn Pesta, West Babylon, NY (US)

(73) Assignee: Pool Cover Corporation, Hauppauge, NY (US)

( * ) Notice: Subject to any disclaimer, the term of this patent is extended or adjusted under 35 U.S.C. 154(b) by 619 days.

(21) Appl. No.: 11/656,731

(22) Filed: Jan. 23, 2007

(65) Prior Publication Data

US 2008/0172782 A1 Jul. 24, 2008

(51) Int. Cl.
*E04H 4/00* (2006.01)

(52) U.S. Cl. ..... 4/503; 4/498; 52/63; 52/222; 135/96; 135/908; 135/119

(58) Field of Classification Search ..... 4/498, 4/503, 160; 160/57, 97, 352; 52/63, 222; 135/96, 908, 119
See application file for complete search history.

(56) References Cited

U.S. PATENT DOCUMENTS

| | | | | |
|---|---|---|---|---|
| 2,958,872 | A * | 11/1960 | Meyer, Jr. | 4/503 |
| 3,683,428 | A | 8/1972 | Morris | |
| 4,429,425 | A | 2/1984 | Weir et al. | |
| 4,601,149 | A | 7/1986 | Dokan | |
| 4,706,427 | A | 11/1987 | Zeilinger | |
| 4,982,457 | A | 1/1991 | Donaton | |
| 5,426,899 | A * | 6/1995 | Jones | 52/63 |
| 5,546,615 | A * | 8/1996 | Chamness | 4/503 |
| 5,555,877 | A | 9/1996 | Lockwood | |
| 5,608,926 | A | 3/1997 | Donaton | |
| 5,800,089 | A | 9/1998 | Donaton | |
| 6,637,162 | B1 | 10/2003 | Holland | |
| 6,836,907 | B1 * | 1/2005 | Pesta | 4/498 |
| 6,854,223 | B1 | 2/2005 | Holland | |
| 6,948,287 | B2 | 9/2005 | Korn | |

* cited by examiner

*Primary Examiner*—Khoa D Huynh
*Assistant Examiner*—Lauren Heitzer
(74) *Attorney, Agent, or Firm*—Alfred M. Walker

(57) ABSTRACT

A swimming pool gap securement assembly prevents the accessibility of persons, animals or other objects into swimming pools, because of gaps left between the edges of a swimming pool cover and the surfaces of vertically rising decorative landscape obstructions associated therewith. The assembly provides one or more protective extensions of a swimming pool cover which covers any gaps present when a swimming pool cover encounters these vertically rising obstructions. These panels, one for each gap encountered, are generally of triangular shape, of the same fabric as the main pool cover or any other pool cover materials, and are sewn into, or otherwise attached to, the reinforced webbing at the edge of the pool cover. The lower horizontal edge and the vertical end edge of the wing extension panel have an attached edge strip with a linear array of holes engageable with one or more anchors imbedded into the deck or on the side of the obstruction itself.

22 Claims, 3 Drawing Sheets

SWIMMING POOL GAP SECUREMENT ASSEMBLY

FIELD OF THE INVENTION

The present invention relates to pool covers for swimming pools having vertically rising obstructions.

BACKGROUND

Although earlier pool covers were typically attached to the inner vertical sides of the pool wall or to adjacent vertically rising obstructions, it is common today for pool covers to be attached to the horizontal decking adjacent the perimeter of the pool. In some pool installations, obstructions rising vertically some distance from the deck adjacent to the edge of the pool prevent the pool cover from level attachment. For example, elaborate landscape construction of the swimming pool environment could include terraces, slopes, simulated rock gardens, spas and boulders which interrupt the normally flat swimming pool deck. By attachment of the pool cover over the obstruction, gaps are formed which should be secured to restore the safety integrity of the pool cover.

Prior art reveals attention to the problem of securing gaps at the edge of pool covers. Exemplary patents include U.S. Pat. No. 2,870,454 of F. J. Schippert et al, U.S. Pat. No. 3,683,428 of Morris, and U.S. Pat. No. 4,982,457 of Donaton. Each of these patents relates to pool covers attached to the vertical wall of a pool, and they do not address the encumbrance of vertically extending obstructions adjacent to the edge of the pool.

OBJECTS OF THE INVENTION

It is therefore an object of the present invention to provide a swimming pool gap securement assembly which prevents the inadvertent falling of persons in gaps left between the edges of a swimming pool cover and the surfaces of vertically rising obstructions.

It is also an object of the present invention to provide one or more protective extensions of a swimming pool cover which covers any gaps present when a swimming pool cover encounters vertically rising obstructions and which promotes swimming pool safety.

Other objects which become apparent from the following description of the present invention.

SUMMARY OF THE INVENTION

This invention addresses the problem of obstructions rising vertically adjacent to the edge of a pool by providing one or more triangular wing extension panels (known in the trade as Loop Loc SECURE-A-GAP™) at the edge of the cover panel cover to securely cover the vertical opening formed by draping the cover panel over the obstruction. These triangular wing extensions panels, one for each gap encountered, are generally of triangular shape, of the same fabric as the main cover panel or any other pool cover materials, and are sewn into the webbing near the edge of the cover panel. Fabric cover panel made be made by weaving, felting, knitting or crocheting. However, other geometric shapes may be applicable, depending upon the size and shape of the gap sought to be eliminated. Other means of attachment other than sewing may be used, such as by stapling, riveting or attachment by glue or other substances. In another alternate embodiment, the triangular wing extension panel may be removably attached to the pool cover panel, in case the vertically rising obstruction is only temporary.

The lower horizontal edge and the vertical end edge of the triangular wing extension panel have an attached edge strip with one or more frequent holes, preferably in a linear array. These holes are intended to register with one or more anchors imbedded into the deck and on the side of the obstruction itself. Besides securing the Loop Loc SECURE-A-GAP™ triangular wing extension panel to the anchors, a long strap similar to the cover panel straps and terminated with spring-loaded attachment mechanism may also be provided at the vertical edge to assist in closing the gap.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
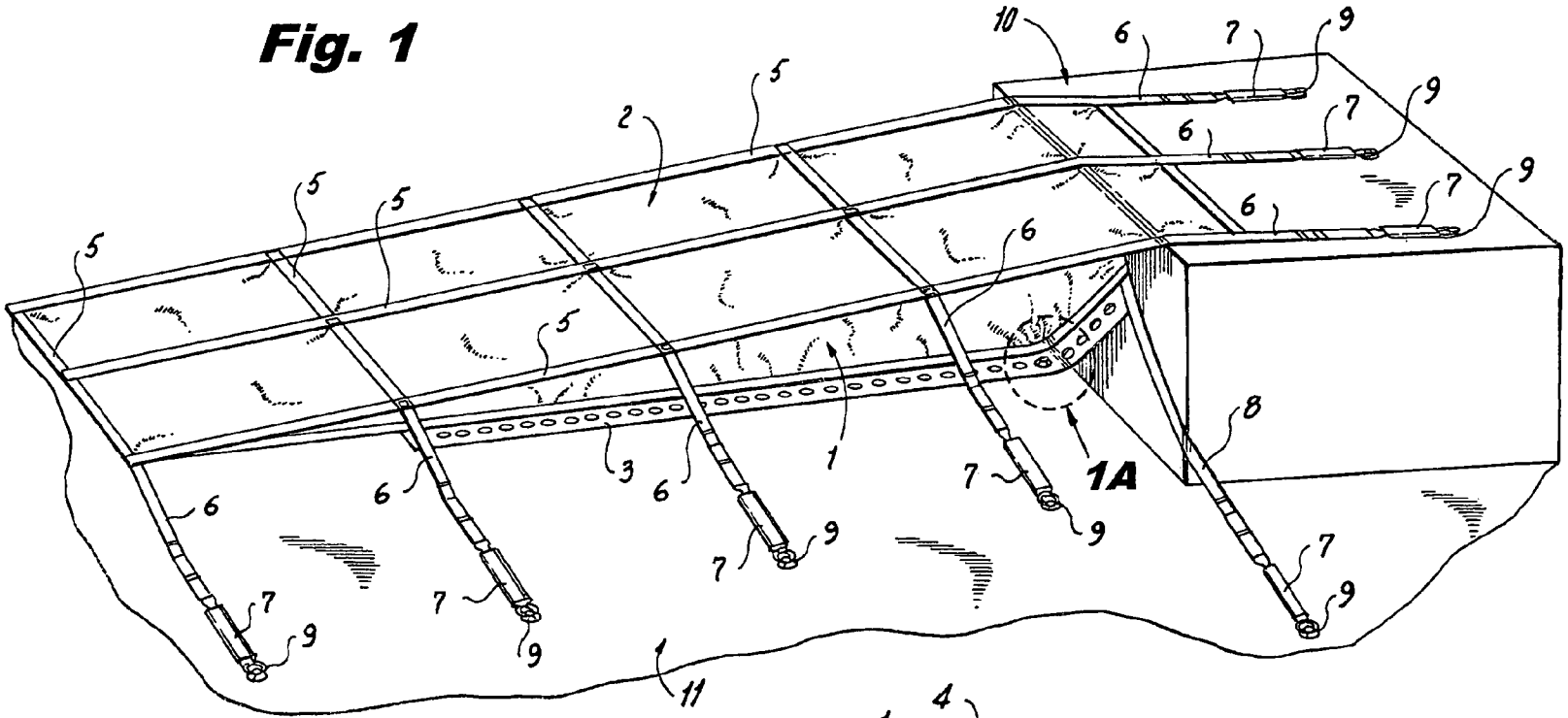
FIG. 1 is a perspective view of a wing extension panel of this invention attached to a pool cover.
Figure 1A:
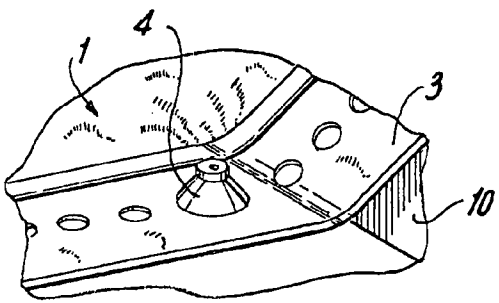
FIG. 1A is a close-up detail view of an attachment for a wing extension panel, as shown in the circle indicated in FIG. 1.
Figure 2:
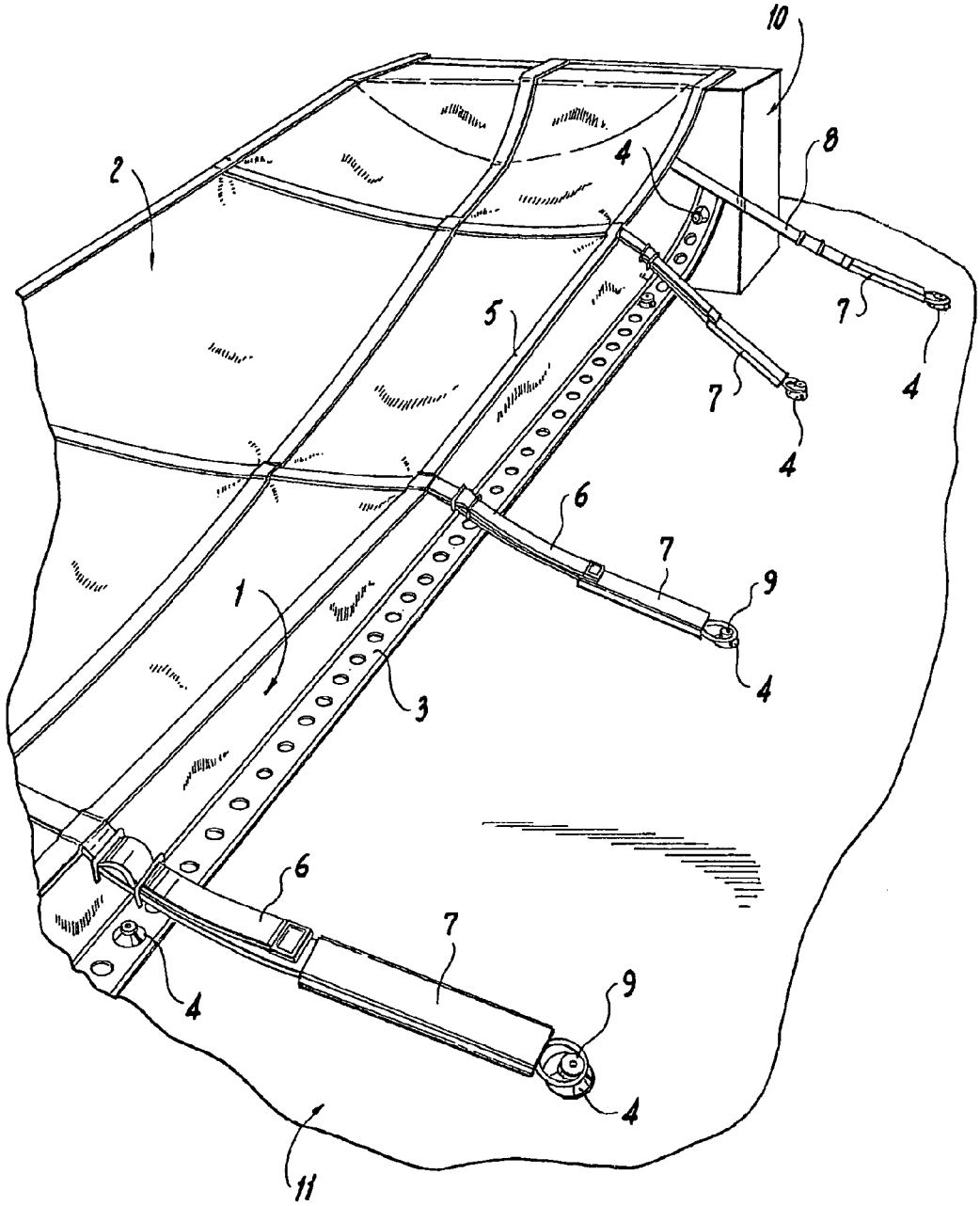
FIG. 2 is a closer perspective detail of the wing extension panel from a higher viewpoint, and, FIG. 3 is a perspective detail of the wing extension panel in the vicinity of the vertical obstruction.
Figure 3:
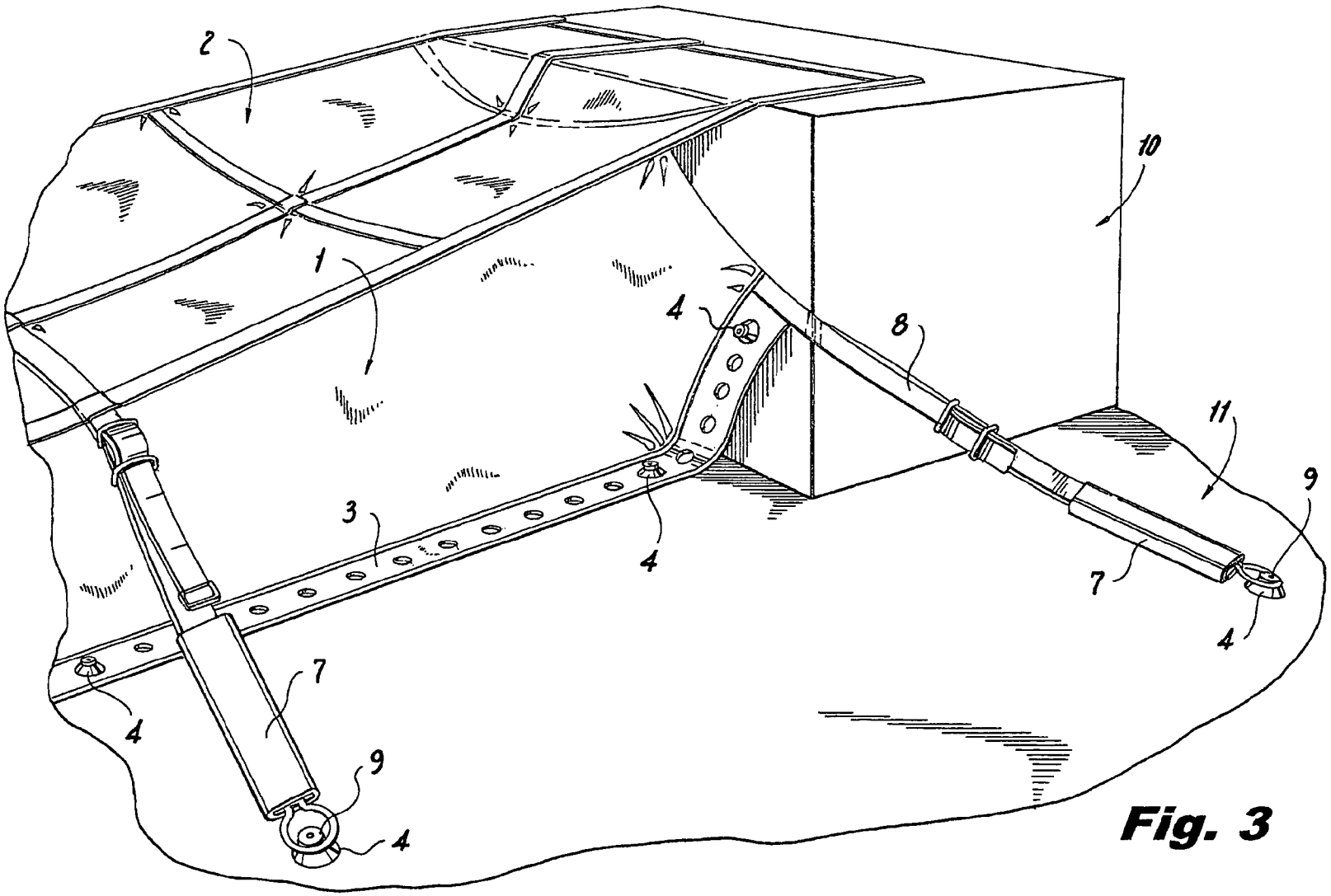

FIGS. 1-3 together illustrate the various features and parts of this invention. A swimming pool cover 2' having a cover panel 2. A section of cover panel 2 adjacent to an edge of a pool with a vertically extending obstruction 10 is shown. Vertically extending "obstruction 10, having a substantially vertically extending inner side wall (12) facing the swimming pool, is" typically part of an elaborate landscape construction of the swimming pool environment, which could include terraces, slopes, simulated rock gardens, spas and boulders, which interrupt the normally flat swimming pool deck as one or more vertically or obliquely extending obstructions.

The construction of cover panel 2 involves a customizable intersecting pattern of reinforced webbings 5 which extend beyond the edge as adjustable straps 6. These straps 6 terminate in spring-loaded mechanisms 7 which then engage knobs 9 extending from anchors 4 screwed into decking 11 around the pool. Where prevented from attachment to deck 11, straps 6 are attached to anchors in obstruction 10 as shown in FIG. 1. Triangular wing extension panel 1 is sewn into the particular reinforced webbing 5*a*, which is located at the edge of cover panel 2. The edge of panel 1 has a strip 3 with an array of closely spaced holes attached to facilitate attachment to deck 11 or obstruction 10 by insertion of anchors 4 in one or more of the holes provided. A long adjustable strap 8, where the distal end attached to a knob on the pool deck attached along an end of triangular wing extension panel 1 as can be clearly seen in FIG. 3. This permits attachment to deck 11 at a convenient anchor point. It is clear that the triangular gap introduced by obstruction 10 is securely closed by triangular wing extension panel 1, thereby preventing access to small children, pets, and objects.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A swimming pool gap securement assembly comprising:

a pool cover for covering an opening of a swimming pool, said pool cover having a cover panel;

a section of said cover panel extending to a vertically extending obstruction, said obstruction having a substantially vertically extending inner side wall which faces said opening, said obstruction mounted on a deck of said swimming pool interrupting the normally flat swimming pool deck adjacent said opening; said section forming a triangular gap between said deck and one edge of said section;

said section of said cover panel having an intersecting pattern of reinforcing webbings which extend beyond edges of said section of said cover panel, said reinforcing webbings extending, laterally and longitudinally, beyond said edges in the form of adjustable straps, said straps each having a distal end carrying means for engaging a knob mounted on said deck of said swimming pool and said obstruction for securing said cover panel section over said opening of said swimming pool;

a triangular wing extension panel attached along one side thereof, via a free edge, to said one edge of said section with an opposite side of said wing extension panel overlapping and being flush with said deck, and with a distal side of said wing extension panel folded flush against said vertically extending inner side wall of said obstruction securely closing said triangular gap formed by said cover panel extending to a top of said obstruction between said vertically extending inner side wall of said obstruction and said deck; and said cover panel and wing extension panel being customized on said pool cover to fit a specific obstruction mounted on said swimming pool deck.

2. The securement assembly of claim 1 having an adjustable strap along said one end of said triangular wing extension panel having a distal end attached to a knob on said deck for retaining said one end of said triangular wing extension panel flush against said side wall of said obstruction.

3. The securement assembly of claim 2 in which the triangular wing extension panel is a fabric.

4. The securement assembly of claim 2 in which the triangular wing extension panel is made of the same material as said pool cover.

5. The securement assembly of claim 2 in which the obstruction is one of a terrace, a slope, a spa and a simulated rock garden with boulders.

6. The securement assembly of claim 2 in which said free edge of said triangular wing extension panel is attached to a reinforcing webbing along the edge of said pool cover.

7. The securement assembly of claim 6 in which said free edge of said triangular wing extension panel is sewn into a reinforcing webbing along the edge of said pool cover.

8. The securement assembly of claim 6 in which said triangular wing extension panel has an array of closely spaced holes to facilitate attachment to said pool deck.

9. The securement assembly of claim 8 in which each knob is attached to an anchor in said pool deck and said obstruction.

10. The securement assembly of claim 9 in which said means for engaging a knob includes a spring loaded mechanism for providing tension on said straps.

11. The securement assembly of claim 8 wherein said triangular wing extension panel is removable.

12. A swimming pool gap securement assembly comprising:

a pool cover for covering an opening of a swimming pool, said pool cover having a cover panel;

a section of said cover panel extending to a vertically extending obstruction, said obstruction having a substantially vertically extending inner side wall which faces said opening, said obstruction mounted on a deck of said swimming pool interrupting the normally flat swimming pool deck adjacent said opening; said section forming a triangular gap between said deck and one edge of said section;

said section of said cover panel having an intersecting pattern of reinforcing webbings which extend beyond edges of said section of cover panel, said reinforcing webbings extending, laterally and longitudinally, beyond said edges in the form of adjustable straps, said straps each having a distal end carrying means for engaging a knob mounted on said deck of said swimming pool and said vertically extending obstruction for securing said cover panel section over said opening of said swimming pool;

a triangular wing extension panel attached along one side thereof, via a free edge, to said one edge of said section with an opposite side of said wing extension panel overlapping and being flush with said deck, and with a distal side of said wing extension panel folded flush against said vertically extending inner side wall of said obstruction securely closing said triangular gap formed by said cover panel extending to a top of said obstruction between said vertically extending inner side wall of said obstruction and said deck;

said free edge of said triangular wing extension panel is attached to a reinforcing webbing along the edge of said pool cover;

said triangular wing extension panel has an array of closely spaced holes to facilitate attachment to said pool deck;

an adjustable strap along said one end of said triangular wing extension panel having a distal end attached to said knob on said deck for retaining said one end of said triangular wing extension panel flush against said vertically extending inner side wall of said obstruction;

said triangular wing extension panel is removable; and said cover panel and wing extension panel being customized on said pool cover to fit a specific obstruction on said swimming pool deck.

13. The securement assembly of claim 12 in which the triangular wing extension panel panel is a fabric.

14. The securement assembly of claim 12 in which the triangular wing extension panel is made of the same material as said pool cover.

15. The securement assembly of claim 12 in which the obstruction is one of a terrace, a slope, a spa and a simulated rock garden with boulders.

16. The securement assembly of claim 12 in which said free edge of said triangular wing extension panel is sewn into a reinforcing webbing along the edge of said pool cover.

17. The securement assembly of claim 12 in which each knob is attached to an anchor in said pool deck and said obstruction.

18. The securement assembly of claim 12 in which said means for engaging a knob includes a spring loaded mechanism for providing tension on said straps.

19. The securement assembly of claim 3 in which said fabric is made by weaving, felting, knitting or crocheting natural or synthetic fibers.

20. The securement assembly of claim 13 in which said fabric is made by weaving, felting, knitting or crocheting natural or synthetic fibers.

21. The securement assembly of claim 12 in which the cover panel is made of a material different from said pool cover.

22. The securement assembly of claim 2 in which the triangular wing extension panel is made of a material different from said pool cover.

* * * * *